United States Patent [19]

Tatsuta et al.

[11] 4,254,208

[45] Mar. 3, 1981

[54] PHOTOGRAPHIC MATERIAL

[75] Inventors: Sumitaka Tatsuta; Masuhiko Hirose; Hiroshi Amari, all of Fujimiya, Japan

[73] Assignee: Fuji Photo Film Co., Ltd., Minami-ashigara, Japan

[21] Appl. No.: 768,456

[22] Filed: Feb. 14, 1977

Related U.S. Application Data

[63] Continuation of Ser. No. 580,273, May 23, 1975, abandoned.

[30] Foreign Application Priority Data

May 23, 1974 [JP] Japan ..... 49-58272

[51] Int. Cl.[3] ..... G03C 1/48; G03C 1/78

[52] U.S. Cl. ..... 430/215; 430/227; 430/231; 430/523; 430/531; 430/533; 430/537

[58] Field of Search ..... 96/85, 87 R, 87 A; 430/215, 227, 231, 523, 531, 533, 537

[56] References Cited

U.S. PATENT DOCUMENTS

| | | | |
|---|---|---|---|
| 2,338,664 | 1/1944 | Nadeau et al. | 96/87 R |
| 2,772,166 | 11/1956 | Fowler | 96/87 R |
| 3,615,545 | 10/1971 | Kalenda | 96/87 R |
| 3,769,022 | 10/1973 | Ville et al. | 96/87 R |
| 3,914,727 | 3/1976 | Timmerman et al. | 96/87 R |
| 4,001,023 | 1/1977 | van Paesschen et al. | 96/87 A |
| 4,019,908 | 4/1977 | Wright | 96/87 R |
| 4,022,622 | 5/1977 | Timmerman et al. | 96/87 A |

*Primary Examiner*—Jack P. Brammer

*Attorney, Agent, or Firm*—Sughrue, Rothwell, Mion, Zinn and Macpeak

[57] ABSTRACT

A process for producing a photographic material, which comprises dispersing, in a solution of an organic resin, a material which is incompatible with the organic resin to form a dispersion, coating the resulting dispersion on at least one side of a support to form a coated layer, and then drying the coated layer, the material dispersed being a solid at ordinary temperature and in a liquid phase during the dispersing, whereby the coated layer when dried contains solid particles dispersed therein due to solidification of the dispersed material.

The present invention also provides a photographic material obtained by the above process.

22 Claims, No Drawings

PHOTOGRAPHIC MATERIAL

This is a continuation of application Ser. No. 580,273, filed May 23, 1975, now abandoned.

BACKGROUND OF THE INVENTION

1. Field of the Invention

The present invention relates to a photographic material and, more particularly, to a photographic material comprising a support with a hydrophobic surface having thereon a photographic layer comprising a hydrophilic colloid.

2. Description of the Prior Art

Heretofore, polyethylene terephthalate, cellulose triacetate, polystyrene, polyolefin-laminated paper, and the like have been used as a photographic support due to their excellent transparency, flexibility, etc. However, it has been extremely difficult to strongly adhere a photographic layer comprising a hydrophilic colloid (represented by gelatin) to these supports due to the highly hydrophobic nature of the surface of these supports.

As processes for obtaining adhesivity between a support and a photographic emulsion layer through a surface treatment, particularly, treatments to render the surface of a hydrophobic support hydrophilic, i.e., processes which have been attempted in the prior art so as to overcome the above-described difficulty, the following two processes have been employed (for example, as disclosed in U.S. Pat. Nos. 2,698,241, 2,764520, 2,864,755, 2,864,756, 2,972,534, 3,057,792, 3,071,466, 3,072,483, 3,143,421, 3,145,105, 3,145,242, 3,360,448, 3,376,208, 3,462,335, 3,475,193; British Pat. Nos. 788,365, 804,005, 891,469, etc.):

(1) a process for obtaining adhesivity by subjecting the support to a surface-activating processing such as chemical processing, mechanical processing, corona discharge processing, flame processing, ultraviolet light-processing, high frequency processing, glow discharge processing, active plasma processing, laser processing, mixed acid processing, ozone-oxidizing processing, or the like, and directly coating thereon a photographic emulsion; and (2) a process of subjecting the support to the above-described surface processing, providing a subbing layer on the support, and coating thereon a photographic emulsion layer.

Of these two processes, process (2) is more effective and widely employed.

The above-described surface processings appear to render the surface of a normally hydrophobic support hydrophilic through formation of polar groups on the surface and, as a result, the affinity for the polar groups of the components contained in a subbing layer is increased.

Also, various techniques have been developed for coating a subbing layer on a support. These techniques basically involve two coating processes; a so-called double layer process which comprises providing a layer adhering well to the support as a first layer and coating on this first layer a hydrophilic resin layer as a second layer; and a single layer process which comprises coating only one resin layer containing both hydrophilic groups and hydrophobic groups on a support.

These processes have been studied in detail, and the adaptability of many resins including copolymers prepared from monomers such as vinyl chloride, vinylidene chloride, methacrylic acid, acrylic acid, itaconic acid, maleic anhydride, etc., polyethyleneimine, epoxy resins, grafted gelatin, nitrocellulose, and the like have been examined. However, unavoidably these processes have the following defects.

(A) Insufficient adhesion strength

That is, the above-described surface-activating processing (1) alone fails to provide satisfactory adhesion strength for practical photographic materials particularly where polyethylene terephthalate, polystyrene, etc., are used as a support. Also, even when a subbing layer is provided on the support, sufficient adhesion strength cannot be obtained, since resins which have a good affinity for a hydrophobic support and adhere well to a hydrophobic support generally have poor affinity for a hydrophilic photographic layer to be coated thereon. Conversely, when a hydrophilic resin having a good affinity for a photographic layer is coated as a subbing layer, there is the defect that this layer does not adhere well to the support even though it adheres well to the photographic layer.

(B) Subbing requires many steps and much time.

Since gelatin is widely used as a resin employed as a binder of a photographic layer, coating and drying of photographic layers are conducted by drying at an extremely low temperature (for example, initially cooling to about 10° C. or less, and then drying at about 50° C. or less) utilizing the special property of gelatin of gelling at a low temperature. However, in providing a subbing layer using the above-described polymers, it is necessary to heat to an elevated temperature to dry after coating (about 100° C. or above) due to the lack of the ability to gel at a low temperature. Furthermore, as to the solvent, while water can be used for gelatin, organic solvents are often used for these synthetic high polymer compounds, and hence coating of the polymers requires a coating machine for organic solvents different from that for coating photographic layers. In addition, in the case of subbing double layers, the steps of coating and drying must be repeated two or three times.

(C) Problems of toxic gases, stimulation on skin and environmental pollution.

A solvent which is capable of swelling or dissolving the support, a so-called etchant, and which has a high polarity, has a high boiling point and is expensive, has been incorporated in a large amount in order to enhance adhesivity of the above-described subbing layer. As etchants for polyesters, compounds having an aromatic nucleus (a benzene ring, a naphthalene ring, a pyridine ring, a pyrrole ring, a fused ring thereof, or those rings substituted with one or more of an alkyl group, an alkoxy group, an acyl group, a nitro group, a cyano group, a halogen atom, a hydroxy group, a formyl group, a carboxy group, an alkoxycarbonyl group, a hydroxyalkyl group, an aminoalkyl group, a haloalkyl group, etc., as substituents), alcohols, ketones, carboxylic acids, esters, aldehydes, and the like (see, e.g., British Pat. Nos. 772,600, 776,157, 785,789, 797,425; U.S. Pat. No. 2,830,030; German Pat. Nos. 1,020,457, 1,092,652, etc.) have been used. To be specific, the following compounds are known, for example, benzoic acid, salicylic acid, salicylic acid esters, monochloroacetic acid, dichloroacetic acid, trichloroacetic acid, trifluoroacetic acid, methanesulfonic acid, trifluoromethanesulfonic acid, nitropropanol, benzyl alcohol, benzaldehyde, acetylacetone, acetylphenol, benzamide, benzonitrile, anisole, nitrobenzyl alcohol, chlorobenzyl alcohol, pyrrole, chloral hydrate, benzylamine, xylylenediamine, nicotinic acid amide, nicotinic acid ester, and the like.

In addition to these, compounds, already well known and commonly used, include those compounds which have a phenolic hydroxy group or groups, such as phenol, o-chlorophenol, p-chlorophenol, dichlorophenol, phenylphenol, chlororesorcin, phloroglucin, orcinol, pyrogallol, gallic acid, o-cresol, m-cresol, p-cresol, resorcin, methoxyphenol, etc.

However, these etchants are generally difficult to handle and are well known to be toxic to humans. Of the compounds, phenolic compounds have such a strong stimulation and permeability on skin that they involve serious working problems. Furthermore, complete recovery is indispensable, since contamination of these substances in discharged waste water and off-gas would cause environmental pollution. This requires additional equipment.

(D) Support planarity is deteriorated.

As is described in items (B) and (C) above, considerably elevated temperatures are necessary in the prior art to dry the subbing layer. In particular, when phenolic compounds are used, the drying of a subbing layer requires quite a long time since they generally possess a high boiling point of 180° C. or higher. Therefore, during the drying step, in particular in the initial stage thereof, a swelling of the polyester and a reduction in elasticity due to an increase in the degree of crystallization occur because of the permeation of the solvent into the support and, in the latter stage, contraction of the polyester occurs. Thus, planarity is seriously damaged.

(E) Temperature control in the step of drying the subbing layer is difficult.

Also, in general, the etching ability of a solvent is greatly dependent upon temperature, and hence, when adhesivity is attained by an anchor effect of the resin to the support, the adhesivity itself is greatly dependent upon the temperature employed in the steps of coating, drying, and the like.

This is an extremely serious problem from the standpoint of stable production.

SUMMARY OF THE INVENTION

The present invention has been developed to overcome these defects encountered in the prior art.

More specifically, an object of the present invention is to provide a photographic material having a strong adhesivity between the support and the photographic layer.

Another object of the present invention is to provide a photographic material suitable for simplifying and shortening the production steps, which enables both a photographic layer and a subbing layer to be coated at the same time.

A further object of the present invention is to provide a photographic material which does not cause environmental pollution.

That is, since production of the photographic material of the present invention does not necessarily necessitate the drying of an organic solvent, no poisonous organic solvent is released in the off-gas or in the water discharged.

Still a further object of the present invention is to provide a photographic material using a subbing solution which is less stimulating to the skin.

An additional object of the present invention is to provide a photographic material having excellent planarity.

An even further object of the present invention is to provide a photographic material having a wide latitude for temperature changes in the production steps.

Still a further object of the present invention is to provide a photographic material which does not require a subbing layer.

These and other objects of the invention will become apparent from the description of the present invention.

The present invention provides a process for producing a photographic material, which comprises dispersing, in a solution of an organic resin, a material which is incompatible with the organic resin to form a dispersion, coating the resulting dispersion on at least one side of a support to form a coated layer, and then drying the coated layer, the material dispersed being a solid at ordinary temperature and in a liquid phase during the dispersing, whereby the coated layer when dried contains solid particles dispersed therein due to solidification of the dispersed material.

The present invention also provides a photographic material obtained by the above process.

DETAILED DESCRIPTION OF THE INVENTION

In using the dispersion of the present invention, which is extremely effective as a subbing solution, it is not at all necessary to incorporate the above-described etchant in the dispersion. However, if desired, the etchant as described above can be incorporated in the subbing solution. With a conventional subbing solution, it has been indispensable to use an etchant for a support, and adhesivity has been obtained by the anchor effect of the etchant between the subbing layer and the support. On the other hand, the subbing solution of the present invention has the important feature that sufficient adhesion can be attained without the use of an etchant.

The present invention will now be illustrated in greater detail below.

Suitable supports used for the present invention include supports comprising every high molecular weight substance. Supports suitable for photographic use are, for example, cellulose derivatives (e.g., cellulose acetate, cellulose acetate butyrate, cellulose acetate propionate, cellulose nitrate, etc.), styrene polymers (e.g., polystyrene, styrene-butadiene copolymer, styrene-butadiene-acrylonitrile copolymer, poly-α-methylstyrene, etc.), polyesters (e.g., polyethylene terephthalate, polyhexamethylene terephthalate, polyethylene-2,6-naphthalate, polycarbonate, etc.), polyolefins (e.g., polyethylene, polypropylene, etc.), papers and the like due to their transparency, flexibility and other chemical properties. Further, supports, dye-containing supports, supports which contain a pigment such as titanium dioxide, laminate films prepared by laminating a plastic on paper, and surface-processed plastic films as described in U.S. Pat. No. 3,515,567, can be used.

Also, as the resin to be coated on a support, resins which have a good affinity for a hydrophilic photographic layer and have high polarity are generally used. Therefore, it is suitable to previously subject the support to the above-described surface-activating processings. In particular, corona discharge, glow discharge, electrode-less discharge, flame processing, and the like are the most preferred from the standpoint of ease in conducting the treatment and the effectiveness achieved.

As to the apparatuses and processes for these activating processings, the descriptions in the above-described patents can be advantageously employed.

The photographic layers to be used in the present invention will be briefly described below.

As the binder (hydrophilic organic protective colloid) for photographic layers, synthetic or naturally occurring hydrophilic high molecular weight compounds such as gelatin, acylated gelatin (e.g., phthaloylated gelatin, malonoylated gelatin, etc.), cellulose derivatives (e.g., carboxymethyl cellulose, hydroxyethyl cellulose, etc.), grafted gelatin prepared by grafting acrylic acid, methacrylic acid, acrylamide or methacrylamide to gelatin, polyvinyl alcohol, polyhydroxyalkyl acrylates, polyvinyl pyrrolidone, copolyvinyl pyrrolidone-vinyl acetate, casein, agarose, albumin, sodium alginate, polysaccharides, agar-agar, starch, grafted starch, polyacrylamide, polyethyleneimine acylated compounds, homopolymers or copolymers of monomers such as acrylic acid, methacrylic acid, acrylamide, methacrylamide, N-substituted acrylamide, N-substituted methacrylamide, etc., or the partially hydrolyzed products thereof can be used. These materials can be used individually or in combination and are described in detail in U.S. Pat. Nos. 2,286,215, 2,322,085, 2,327,808, 2,541,474, 2,563,791, 2,768,154, 2,808,331, 2,852,382, 3,062,674, 3,142,586, 3,193,386, 3,220,844, 3,287,289, 3,411,911, German Pat. Nos. 1,003,587, 1,046,492, etc.

As long as the above-described hydrophilic high molecular weight compounds are used as the binder, it is not particularly important in the present invention what additives are incorporated therein. However, in these hydrophilic binders silver halides, physical development nuclei used in diffusion transfer photography such as silver sulfide, noble metal colloids, etc., light-sensitive materials including diazo compounds, various additives, couplers, emulsion polymerization latex polymers, carbon black, and the like are ordinarily employed.

As is described above, all binders for photographic layers are hydrophilic, and hence it has been difficult in the prior art to directly adhere them onto a hydrophobic support. Incidentally, as the above-described binder, a compatible mixture of two or more of the binders can be used, if desired. Of the above-described binders, gelatin is most generally used. Gelatin can be replaced, completely or partly, by a synthetic high molecular weight substance or by a so-called gelatin derivative.

As the resin to be used as a subbing layer, the same resin as the resin of the photographic layer to be coated thereon is preferred from the standpoint of good adhesivity. However, other combinations can be used and, in addition, resins containing groups which are comparatively hydrophilic can be used in addition to those described above. That is, what is difficult in the art of subbing is to strongly adhere the hydrophobic support to the hydrophilic resin. Adhesivity between hydrophilic resins can be obtained comparatively easily since a strong polar binding force works therebetween. Therefore, if the hydrophilic resin is successfully adhered to the hydrophobic support, the objects of subbing will be substantially attained. The present invention enables the above-described objects to be obtained with all hydrophilic resins.

That is, an important characteristic of the photographic material of the present invention is the constitution of its subbing layer. When a subbing layer having the constitution of the present invention is employed, the adhesivity between the subbing layer and the support is markedly increased regardless of the kind of the resin constituting the subbing layer, as compared with the case of coating the same resin alone as a uniform phase.

Therefore, if the adhesion between the hydrophilic subbing layer resin and a photographic layer is good, the resulting photographic material possesses an extremely strong adhesivity between the support and the photographic layer. Resins having a good affinity for photographic layers are polymers comprising monomers containing a so-called polar group(s) in the molecule thereof (e.g., a carboxy group, a carbonyl group, a hydroxy group, a sulfo group, an amino group, an amido group, an epoxy group, an acid anhydride group, etc.), such as acrylic acid, sodium acrylate, methacrylic acid, itaconic acid, crotonic acid, sorbic acid, itaconic acid anhydride, maleic anhydride, cinnamic acid, methyl vinyl ketone, hydroxyethyl acrylate, hydroxyethyl methacrylate, hydroxychloropropyl methacrylate, hydroxybutyl acrylate, vinylsulfonic acid, potassium vinylbenzenesulfonate, acrylamide, N-methylacrylamide, acryloylmorpholine, dimethylmethacrylamide, N-t-butyl-acrylamide, diacetoneacrylamide, vinylpyrrolidone, glycidyl acrylate, glycidyl methacrylate, etc., and copolymers of these monomers and other copolymerizable monomers, as well as copolymers of the above-described resins.

For example, homopolymers comprising ethylenically unsaturated esters or ethylenically unsaturated acids represented by acrylates (e.g., ethyl acrylate, butyl acrylate, etc.), methacrylates (e.g., methyl methacrylate, ethyl methacrylate, etc.), acrylic acid, methacrylic acid or the derivatives thereof, copolymers thereof and other vinyl monomers, copolymers of a polycarboxylic acid (e.g., itaconic acid, itaconic acid anhydride, maleic acid, maleic anhydride, etc.), and a vinyl monomer (e.g., styrene, vinyl chloride, vinylidene chloride, butadiene, etc.), terpolymers of these monomers and other ethylenically unsaturated monomers are suitable. These can be used as an aqueous solution, as an organic solvent solution (for example, using a wide variety of solvents, e.g., water, an alcohol such as methanol, an ester such as ethyl acetate, a ketone such as methyl butyl ketone, a halogenated hydrocarbon such as tetrachloromethane, etc.), or as a liquid dispersed in water as a latex.

The aspect of the present invention lies in obtaining a strong adhesivity between the support and the resin layer by using a dispersion prepared by dispersing in the above-described resin, particularly in a hydrophilic resin, a fine solid material or a material which becomes solid upon drying. In other words, the aspect of the present invention lies in providing on a support a resin layer wherein the solid material is dispersed in a macroscopically uniform state in an order larger than the size of a single molecule, forming a different phase from that of the resin. Thus, it has now become possible to directly adhere every hydrophilic resin strongly to a support, particularly to a hydrophobic support, by dispersing fine solid materials in the resin, which has been previously believed to be impossible. Therefore, as long as the resin layer has the above-described constitution, the chemical properties of the dispersed solid do not substantially exert any direct influence on the effects of the present invention. That is, any solid material can serve to achieve the effects of the present invention so long as (1) the melting point or softening point of the solid material i not less than ordinary temperature (about 15° C. to 30° C.) and (2) the solid material does not diffuse into the resin used in a size larger than a single molecule. Thus, the solid materials can be either low molecular weight compounds or high molecular weight compounds. In short, all that is required is that a suitable material be selected from conventionally known solid materials depending upon the resin used and the solvent used. Taking for instance gelatin and water as a hydrophilic resin and a solvent, respectively, examples of solid materials which can be effectively dispersed therein include water-insoluble solids having a melting point of 15° C. or higher. Examples of such materials are 2,4,6-tribromoaniline, 1,2,4-tribromobenzene, β-naphthonitrile, 1-nitroanthraquinone, 3-nitro-d-camphor, 4-nitrobiphenyl, hydrobenzamide, biphenyl, phenyldisulfoxide, phthalophenone, furfuralphenylhydrazine, 1-bromo-2,4-dinitrobenzene, hexaethylbenzene, hexachlorobenzene, N-benzylacetamide, o-benzamidobenzoic acid, benzanilide, 1,2-benzanthraquinone, N-benzoyl-p-toluidine, pentachlorophenol, pentachlorobenzene, pentamethylbenzene, benzoic anhydride, succinic anhydride, 1-methylanthracene, β-iodonaphthalene, triphenyl phosphate, hexachlorobenzene, dimethylnaphthalene, β-methylnaphthalene, m-acetamidobenzoic acid, 2,2'-azoxynaphthalene, anisole, β-aminoanthraquinone, aminoanthracene, ethyl benzoate, phenyl benzoate, benzyl benzoate, anthraquinone, anthracene, eicosane, 9-ethylanthracene, ethylene diphenyl ether, 1-hydroxyanthraquinone, 1-hydroxyanthracene, ω-chloroacetophenone chlorophyll, β-naphthyl acetate, benzyl cyanurate, 2,3-dichloroanthracene, 2,3-dichloronitrobenzene, p-dichlorobenzene, di-α-naphthylamine, N,N'-diphenylethylenediamine, 4,4'-dimethylbenzophenone, 2,4-dimethoxybenzaldehyde, camphor oxime, 1,2,3-trichlorobenzene, triphenylcarbinol, triphenylmethane. These compounds and their corresponding melting points are described in, e.g., *Kagaku Binran Basic Part,* pp. 165~360, 1966 (edited by Nihon Kagaku Kai, Maruzen), and appropriate compounds can be selected from these compounds.

Also, 2- or 4-equivalent, oil-soluble couplers known in the field of color photography, such as open-chain active methylene type compounds, pyrazolone type compounds, phenol or naphthol type compounds, and the like can be used. Descriptions of these compounds are given in, e.g., U.S. Pat. Nos. 2,271,238, 2,289,805, 2,357,394, 2,474,293, 2,537,394, 2,550,661, 2,589,004, 2,600,788, 2,710,802, 2,721,798, 2,772,161, 2,875,057, 2,895,826, 2,908,573, 2,920,961, 2,927,928, 3,062,653, 3,393,071, 3,441,414, 3,580,721, 3,615,504; British Pat. Nos. 737,700, 843,497, 843,940, 849,065, 852,922, 865,492, 909,318, 939,904, 944,838, 969,921, 980,507, 997,500, 1,039,452, 1,149,514, 1,184,489, 1,205,281, 1,211,651, 1,221,639, 1,234,269, 1,240,600, 1,240,804, 1,245,448, 1,249,287, etc., and a suitable coupler can be selected from these couplers.

Also, acids such as aliphatic acids (e.g., capric acid, lauric acid, stearic acid, palmitic acid, sebacic acid, pimelic acid, behenic acid, etc.), the esters or amides thereof (e.g., amide with diethylamine), low molecular weight compounds such as solid paraffin, and the like, and polymers can be used. That is, synthetic resins such as the so-called addition polymers in which unsaturated bond participates, ring-opened polymerization products and polycondensation products; synthetic high molecular weight substances employed as synthetic fibers or synthetic rubbers; naturally occurring high polymers such as natural rubber, cellulose, proteins, etc.; and the derivatives thereof can be employed.

Examples of synthetic high molecular weight compounds are homopolymers or copolymers of monomers such as olefins, allyl compounds, halogenated olefins, styrenes, hetero ring vinyl compounds, acetylenes, allenes, butadienes, N-vinyl compounds, vinyl esters, vinyl ethers, vinyl ketones, acrylic acids, acrylonitriles, acrylamides, methacrylic acids, oxiranes, lactams, etc. Also, examples include various polymers such as polyimines, polyesters, polyethers, polycarbonates, polysulfides, polysulfones, polysulfonamides, polypeptides, polyamides, polyimides, polyurethanes, polyureas, polyacid anhydrides, alkyd resins, unsaturated polyesters, epoxy resins, ketone resins, phenol resins, urea resins, melamine resins, furan resins, xylene resins, toluene resins, aniline resins, diallyl phthalate resins, silicone resins, etc. For example, there are oligomers or polymers such as halogen-containing synthetic resins (e.g., polyvinyl chloride, polyvinyl bromide, polyvinyl fluoride, polyvinylidene chloride, chlorinated polyethylene, chlorinated polypropylene, brominated polyethylene, rubber chlorohydride, a vinyl chloride-ethylene copolymer, a vinyl chloride-propylene copolymer, a vinyl chloride-styrene copolymer, an isobutylene chloride copolymer, a vinyl chloride-vinylidene chloride copolymer, a vinyl chloride-styrene-maleic anhydride terpolymer, a vinyl chloride-styrene-acrylonitrile copolymer, a vinyl chloride-butadiene copolymer, a vinyl chloride-isoprene copolymer, a vinyl chloride-propylene chloride copolymer, a vinyl chloride-vinylidene chloride-vinyl acetate terpolymer, a vinyl chloride-acrylic ester copolymer, a vinyl chloride-maleic acid ester copolymer, a vinyl chloride-vinyl methacrylate copolymer, a vinyl chloride-acrylonitrile copolymer, internally plasticized polyvinyl chloride, a vinyl chloride-vinyl acetate copolymer, polyvinylidene chloride, a vinylidene chloride-methacrylic ester copolymer, a vinylidene chloride-acrylonitrile copolymer, a vinylidene chloride-acrylic ester copolymer, a chloroethyl vinyl ether-acrylic ester copolymer, polychloroprene, etc.), α-olefin polymers (e.g., polyethylene, polypropylene, polybutene, poly-3-methylbutene, poly-1,2-butadiene, etc.), and copolymers (e.g., an ethylene-propylene copolymer, an ethylene-vinyl ether copolymer, an ethylene-propylene-1,4-hexadiene copolymer, an ethylene-vinyl acetate copolymer, a copolybutene-1-propylene copolymer, a butadiene-acrylonitrile copolymer, etc.) blended products of these polymers with a halogen-containing resin; acrylic resins (e.g., a methyl acrylate-acrylonitrile copolymer, an ethyl acrylate-styrene copolymer, a methyl methacrylate-acrylonitrile copolymer, polymethyl methacrylate, a methyl methacrylate-styrene copolymer, a butyl methacrylate-styrene copolymer, polymethyl acrylate, polymethyl α-chloroacrylate, polymethoxyethyl acrylate, polyglycidyl acrylate, polybutyl acrylate, polymethyl acrylate, polyethyl acrylate, an acrylic acid-butyl acrylate copolymer, an acrylic ester-butadiene-styrene terpolymer, a methacrylic ester-butadiene-styrene terpolymer, etc.); polystyrenes such as polystyrene, poly-α-methylstyrene, a styrene-dimethyl fumarate copolymer, a styrene-maleic anhydride copolymer, a styrene-butadiene copolymer, a styrene-butadiene-acrylonitrile copolymer, poly-2,6-dimethylphenylene oxide, a styrene-acrylonitrile copolymer; polyvinyl carbazole, poly-p-xylylene, polyvinyl formal, polyvinyl acetal, polyvinyl butyral, polyvinyl acetate, polyvinyl phthalate, cellulose triacetate, cellulose butyrate, cellulose butyrate acetate, cellulose phthalate, nylon 6, nylon 66, nylon 12, methoxymethyl-6-nylon, nylon 6,10 polycapramide, poly-N-butylnylon-6, polyethylene sebacate, polybutylene glutarate, polyhexamethylene adipate, polybutylene isophthalate, polyethylene terephthalate, polyethylene adipate, polyethylene adipate terephthalate, polyethylene-2,6-naphthalate, polydiethylene glycol terephthalate, polyethyleneoxybenzoate, bisphenol A-isophthalate, polyacrylonitrile, bisphenol A-adipate, polyhexamethylene-m-benzenedisulfonamide, polytetramethylenehexamethylene carbonate, polydimethylsiloxane, polyethylenemethylenebis-4-phenylene carbonate, bisphenol A-polycarbonate, etc., with the resins of course not being limited only to these. These resins are described in detail in E. H. Immergut, *Polymer Handbook,* IV, pp. 187~231, Interscience, New York, (1966). Of these, solids which are industrially inexpensive and readily available, which have good photographic properties for all light-sensitive photographic layers and can be easily dispersed, and which have excellent film transparency after drying and excellent multilayer coating adaptability, and those which have a melting point of about 40° C. or above, higher aliphatic acids, paraffins, and the like and, in particular, solid paraffins can be advantageously used from the standpoint of adaptability as a photographic material. This is believed to be because paraffins are chemically inert due to their molecular structure and because the particle stability thereof in a dispersed state is quite good due to their high hydrophobic property so that they can be uniformly dispersed in a resin with ease.

Where resins to be used are other than gelatin, the effects of the present invention can be achieved by selecting the resin and a solid which is not compatible with the resin.

The combination and the process of using the combination depend upon the kind of resins or solids used, and it can be decided through simple trial-and-error method whether the solid is to be dispersed as a solvent solution or dispersed after liquifying the solid by heating it to a temperature higher than its melting point.

For example, in order to effectively disperse these solids in the resin as fine solid particles, (1) the solid is either heated to a temperature higher than the melting point to liquify the solid or dissolved in a solvent for the resin and the resin solution or in a volatile liquid which is not very compatible with the resin, the resin solution and the dispersion solvent for the resin but compatible with this solid, (2) the resulting liquid is added to the resin solution and the mixture is stirred, subjected to blooming, subjected to ultrasonic vibration, or the like to apply a shearing force, (3) the resulting dispersion or emulsion is coated on a desired support, and (4) the coating is finally dried and, if necessary, cooled. Thus, the objects of the present invention are attained.

The thus-obtained resin film comprises fine solid particles uniformly dispersed in a solid resin matrix. This very construction serves, surprisingly, to markedly improve the adhesiveness between the support and the resin film. It has heretofore been known to reduce residual stresses generated in the coated film to improve adhesiveness by incorporating a flat inorganic filler or polymer latex particles in the adhesive layer. However, since the filler or particles are dispersed as a solid both during addition and completion of the coating, the particles themselves are large in size. Therefore, there have been the defects that the transparency of the film is deteriorated, that the dispersion is non-uniform, and that solid agglomerated materials are formed due to a second aggregation of the particles. In addition, adhesiveness is not improved to a very great extent.

Also, another conventional technique comprises a process of incorporating a foreign material, called a plasticizer, in a resin. In this case, however, this foreign material has good compatibility with the binder and diffuses into the resin in the molecular order, resulting in an exuding onto the surface, adhesion of the surface due to the exudation, repellancy to a layer to be coated thereon, shift of the plasticizer in the depthwise direction of the film and a poor distribution of the plasticizer, thus causing fatal defects such as a curling of the film, and the like.

In contrast, when the present invention is employed, the solid material is initially liquified and finely dispersed in a resin solution and, in the drying or cooling step after coating, the material again gradually changes to a solid or precipitates in the resin film. Therefore, the thus-formed film contains the solid extremely uniformly and finely dispersed therein and is free of internal strains (which affect the adhesiveness as residual stresses). Thus the adhesivity between the support and the resin film is markedly improved. In addition, since this solid is not compatible with the binder resin, no difficulties such as diffusion through the resin to exude onto the surface occur, and is retained in the resin layer in a stable manner.

As the process for uniformly dispersing the liquified material which is solid at ordinary temperature, those emulsifying or dispersing processes which have heretofore been used in the field of photographic emulsions, cosmetics, etc., can be employed as such.

That is, the liquid can be sufficiently finely dispersed or emulsified by mixing the resin solution with the liquid to be dispersed and applying thereto a strong shearing force by means of a mixer, homogenizer, ultrasonic waves, etc.

During dispersion, a generally employed emulsifying agent is preferably added in order to increase the efficiency of emulsification and/or to stabilize the resulting emulsion dispersion. Any anionic surface active agents, nonionic surface active agents, cationic surface active agents and the mixtures thereof can be advantageously used as the emulsifier. However, from the standpoint of photographic properties, anionic and nonionic surface active agents are preferred.

Also, as a surface active agent suitable for reducing the particle size, anionic surface active agents described in Japanese Patent Publication No. 9979/73 are preferred. Where foaming occurs upon emulsification, a defoaming agent can be added, e.g., as described in Japanese Patent Publication No. 9979/73.

Detailed descriptions of surface active agents are given in U.S. Pat. Nos. 2,240,472, 2,271,623, 2,288,226, 2,311,021, 2,322,027, 2,360,289, 2,533,514, 2,739,891, 2,801,170, 2,801,171, 2,852,382, 2,949,360, 3,068,101, 3,158,484, 3,201,253, 3,210,191, 3,294,540, 3,396,027, 3,415,649, 3,441,413, 3,442,654, 3,475,174, 3,545,974, 3,619,195, 3,775,349; West German Patent Application (OLS) No. 1,942,665; German Pat. Nos. 1,143,707, 2,045,414, 2,043,271, 2,045,464; British Pat. Nos. 1,077,317, 1,198,450, etc., in addition to the above-described Japanese Patent Publication. One or more surface active agents can be selected from these materials disclosed. The amount of the surface active agents can be optionally varied. However, the amount of the surface active agent is at least a sufficient amount to substantially obtain an emulsion.

The dispersed solid is thus precipitated as particles by drying after coating where the solid is liquified by dissolving in a compatible, volatile solvent, or by cooling after coating where the solid is liquified by heating to a temperature higher than the melting point of the solid. The size of the precipitated particles is influenced by the size of initially dispersed liquid droplets. Therefore, the smaller the size of dispersed liquid droplets, the better are the results taking the transparency of the coated layer into consideration. Where coating a subbing layer is conducted as a separate step and, after drying the subbing layer, photographic layers are coated thereon as in the prior art, the thickness of the subbing layer is usually not more than about 1$\mu$, since a subbing layer which is too thick is susceptible to being damaged. In such a case, the size of the liquid droplets is preferably not greater than about 1$\mu$. However, since gelatin can be used for obtaining the photographic material is accordance with the present invention, the subbing layer can be provided as a lowermost layer of the photographic layers simultaneously with the coating of the photographic layers using multi-layer coating techniques. Therefore, in this case, a thick subbing layer can be used since there is no possibility that the subbing layer will be damaged. In such a case, a liquid droplet (dispersed particle) size of not less than about 1$\mu$ is effective to some extent from the standpoint of adhesion. Therefore, the size of dispersed liquid droplets should be less than the thickness of the subbing layer for satisfactory results. In fact, however, where the droplet size is large, the stability of the coating solution itself with the lapse of time is poor and, in some cases, the opacity of the coated film increases. Thus, the size of the liquid droplet is preferably not more than about 1$\mu$. There is no limitation on the lower limit of the size of the liquid droplets. In fact, when the particle size of liquid droplets is changed while keeping constant the volume ratio of the liquid to be dispersed, the solid content therein and the binder resin constant, the smaller are the liquid droplets, the more improved is the transparency of the coated film and adhesion strength.

As was stated hereinbefore, the liquid droplets can be formed by applying a strong shearing stress to the liquid using a mixer or a homogenizer, and with the help of a surface active agent. According to the prior art, stable liquid droplets of a mean particle size of about 0.01$\mu$ can be formed with ease, and can be utilized in the present invention. Usually, the objects of the present invention are fully achieved using liquid droplets of a mean particle size of about 1 to 0.01$\mu$.

The liquid droplets used in the present invention can be an emulsion simultaneously prepared by using one or more solids and/or solvents, an emulsion prepared by separately emulsifying and mixing one or more solids, or a redispersed emulsion containing one or more solids. That is, an emulsion of a monodisperse system or a polydisperse system, having a wide or narrow particle size distribution, can be used.

As to the resin used for the subbing layer and the amount of solid to be dispersed therein within the range where amount of solid is comparatively lower than the amount of the resin, the adhesion strength increases as the solid amount increases, with any combination of resin and solid. In particular, however, where an emulsion prepared by dissolving the solid in a solvent and dispersing the solution is used, a resin solution containing the total amount of the solid and the solvent dispersed therein is coated and dried. Therefore, in such a case, the solvent of the resin solution is first mainly evaporated to form a film containing a liquid dispersion therein, and then the volatile ingredient of the liquid contained is evaporated with the solid gradually precipitating. Thus, if the ratio of the liquid for dispersion, to be added at first, to the binder resin is too large, the liquid droplets are not maintained subsequently in the resin film during the above-described step, a destruction or coalescence of the liquid droplets results. Thus, the adhesion force is again reduced.

Therefore, although the amount of the solid which can be possibly added depends upon the film-forming property of the resin itself used, the film strength, the solubility of the solid in the solvent for liquifying the solid, the evaporation rate of the solvent and changes in properties due to the combination employed, the solid in an amount of up to about 3:1 (by volume) of the solid to the resin can be generally incorporated into the resin. Also, taking adhesiveness, film strength, transparency, film smoothness, multilayer-coating adaptability, and the like into consideration, a particularly preferred amount of the solid is about 0.1 to 2 times as much as the volume of the dried resin.

After coating the resin solution containing the initially liquified solid dispersed therein as described above on a support, the solution is dried or further cooled to form a resin film containing the reprecipitated solid particles finely dispersed therein on the support. This coated film has a markedly excellent adhesivity to the support, as compared with the same resin film which does not contain the solid particles dispersed therein. This may probably be attributed to the residual stresses generated by the contraction of the coated film during the step of drying the film being markedly reduced to a low level by the fine solid particles. This can be surmized from the fact in the present invention that the adhesivity of the coated film can be improved with any subbing resin and any solid to be dispersed. Also, the photographic material of the present invention has the advantage that, since contraction stresses do not occur upon drying the coated film, curling of films which has been encountered in the prior art also does not occur. It is also quite surprising that the thus-prepared film with solid particles incorporated therein possesses sufficient transparency to be used satisfactorily as a photographic material.

In order to prevent a reduction of the limiting viscosity due to the processing of rendering the surface of the support hydrophilic and to enable the repeated use of the support such as a polyester support, if desired, compounds having one or more groups selected from a carboxy group, a methylol group, a hydroxy group, an oxirane group, an epoxy group, a glycidyl group, an ethyleneimino group, an isocyanato group, a thioisocyanato group, an acetal group, a ketal group, a vinyl group, an acryloxy group, a methacryloxy group, a carbodiimido group, a phenolic hydroxy group, a thiol group, an amino group, an alkylamino group, an acylamino group, a carbamoyl group, a thiocarboxy group, a thiocarbamoyl group, a guanidyl group, a hydrazino group, an oxime group, a ureido group, a thioureido group, etc., such as diepoxy compounds and polyisocyanates can be incorporated in the layer containing the solid particles of the present invention so as to mitigate the effects of the processing conditions.

Also, resins, emulsion polymerization products and the like can be incorporated in the layer containing the solid particles. Descriptions of suitable latexes are given in U.S. Pat. Nos. 3,142,568, 3,193,386, 3,062,674, 3,220,844, 3,287,289, 3,411,911, 3,411,912, 3,488,708, etc., and those skilled in the art can easily select a suitable latex from these materials depending upon the purpose, end-use and use conditions of the material obtained according to the process of the present invention.

Of the photographic materials of the present invention, a particularly useful photographic material from an industrial viewpoint is a material wherein gelatins are used as a subbing resin. Since the main ingredient of the resin of photographic layers provided on the subbing layer is in many cases a hydrophilic resin, particularly gelatin, the affinity between the photographic layer and the subbing layer is extremely high providing sufficent adhesiveness therebetween and gelatin is gelled (set) at a low temperature, and thus, the subbing layer can be coated simultaneously with the coating of the photographic layers. That is, simultaneous cast-coating is possible. In this process, no special subbing machine for subbing the support is necessary and one step is omitted. Thus, difficulties during the subbing step are removed.

As was described hereinabove, the present invention is industrially quite significant in that the present invention enables, for the first time, a gelatin layer to be directly adhered intimately to a hydrophobic support by providing a subbing layer comprising the construction of the present invention.

Additionally, since a feature of the present invention lies in the presence of fine solid particles in a subbing layer to thereby improve the adhesivity, it is clear that incorporation of other ingredients than those naturally necessary for adhesion, such as an antistatic agent, a dye, a coating aid, a matting agent, a cross-linking agent, etc., does not at all destroy the gist or spirit of the present invention.

Also, according to the concept of the present invention, the same objects can be achieved by directly dispersing the solid particles in a photographic layer without particularly providing a subbing layer, if the change in photographic property and the increase in opacity are not of concern. In this case, the photographic layers can be directly coated on the support without a subbing layer, which is extremely useful from an industrial standpoint.

The subbing solution of the present invention and each of the photographic light-sensitive layers can be coated using various coating methods including a dip-coating method, an air knife-coating method, a curtain-coating method and an extrusion coating method using a hopper described in U.S. Pat. No. 2,681,294.

If desired, two or more layers can be simultaneously coated according to the methods described in U.S. Pat. Nos. 2,761,791, 3,508,947, 2,941,898, 3,526,528; Harazaki, *Coating Engineering*, p. 253, Asakura Shoten, Tokyo, (1973), and the like.

The present invention will now be illustrated in greater detail by reference to the following non-limiting examples of preferred embodiments of the present invention. Unless otherwise indicated, all parts, percents, ratios and the like are by weight.

In the examples, the adhesivity was evaluated in the following manner.

1. Method of Testing Film Adhesiveness

Six notches or cuts were made on a photographic layer to be tested at an interval of 5 m/m in each of the lateral and the longitudinal directions to form 25 squares, and an adhesive tape (Scotch Mending Tape, made by Sumitomo-3M) is applied thereto. The adhesivity was rated in 5 grades in terms of the number of squares of the photographic layer delaminated by quickly stripping the tape from the sample at a 180° direction.

| Grade | Number of Delaminated Squares |
|---|---|
| A | 0~5 |
| B | 6~10 |
| C | 11~15 |
| D | 16~20 |
| E | 21~25 |

Of the above-described 5 grades, the adhesion strength practically usable for a photographic material is a grade of not less than B, preferably a grade of A.

2. Method of Testing Wet Film Adhesiveness 1 cm×1 cm "×" marks were formed on a film surface in each solution employed in development processing using a stencil pen, and the marks were strongly rubbed 20 times with a finger tip.

The adhesion force was rated in 5 grades in terms of the maximum delamination length along the "×" mark line.

| Grade | Maximum Delamination Length |
|---|---|
| A | 0 ~0.9 m/m |
| B | 1.0~2.9 m/m |
| C | 3.0~5.0 m/m |
| D | No resistance |
| E | Spontaneously delaminated |

Of the above-described 5 grades, an adhesion strength practically usable for a photographic material is a grade of not less than B, preferably a grade of A.

EXAMPLE 1

15 g of a 5% by weight aqueous solution of sodium dodecylbenzenesulfonate (emulsifier) was added to 200 g of a 10% by weight gelatin aqueous solution maintained at 60° C. Then, 10 g of 5-[2-(2,4-di-t-amylphenoxy)butyramido]-2-chloroaniline dispersed in 40 cc of ethyl acetate was added thereto as a solid to be dispersed, and the mixture was stirred for 20 minutes using a mixer to prepare a subbing solution.

The resulting subbing solution was coated on a 0.1 mm-thick polyethylene terephthalate support, subjected to corona discharge-processing, in a dry thickness of 2μ and, after setting for 1 minute at about 5° C., dried for 30 minutes at 25° C. The corona discharge processing was conducted by running a 30 cm-wide film between electrodes at a rate of 2 m/min at a discharge electric power of 1 kw and an electrode separation of 1.6 mm. The transparency of the film after drying was extremely good. On the thus subbed film a conventional silver bromoiodide (silver iodide: 2.5 mol %) gelatin emulsion was coated at a coverage of 3 g/m$^2$ of silver and 3.5 g/m$^2$ of gelatin and, after setting for 1 minute at 5° C., dried for 30 minutes at 30° C. The adhesiveness of the thus obtained film was grade A both in the dry state and in wet adhesiveness in each of the processing solutions used for development, fixing and washing.

On the other hand, the adhesiveness of a sample prepared by using the same subbing solution except that the above-described solid was not incorporated therein was grade E both in a dry state and in processing solutions.

EXAMPLE 2

A subbing solution prepared in the same manner as in Example 1 except for using a solid paraffin (m.p.: 58° C.) in the amount shown in the following table in place of the Compound in Example 1 was coated in a dry thickness of 1μ on each of 0.2 mm-thick polyethylene terephthalate supports having been subjected to glow discharge-processing and, after setting for 1 minute at 5° C., dried for 30 minutes at 25° C.

The glow discharge processing was conducted for 1 second at a power of 2000 w under a reduced pressure of 0.05 mmHg.

On the thus-subbed films was coated the same emulsion as in Example 1 at a coverage of 3 g/m$^2$ of silver and 3.5 g/m$^2$ of gelatin and, after setting for 1 minute at 5° C., dried for 30 minutes at 30° C. The transparency of the thus-obtained film was good. The results of adhesiveness are shown in Table 1.

TABLE 1

| Amount of Solid Paraffin (g) | Adhesivity (dry) | Adhesivity (in developing solution) |
|---|---|---|
| 0 (control) | E | E |
| 2 | C | C |
| 4 | A | A |
| 6 | A | A |
| 8 | A | A |
| 10 | A | A |

Apart from the above test, when 20 g of the solid was used, paraffin appeared on the subbing layer surface, resulting in a deterioration of the adhesion between the subbing layer surface and the photographic emulsion layer.

Thus, it can be seen that an effective amount of solid paraffin based on 20 g of gelatin is about 3 to 15 g.

EXAMPLE 3

15 g of a 5% by weight aqueous solution of sodium dodecylbenzenesulfonate (emulsifying agent) was added to 200 g of a 10% by weight gelatin aqueous solution maintained at 70° C. Then, 6 g of solid paraffin (m.p.: 58° C.) melted at 70° C. was added thereto and the mixture was stirred for 20 minutes using a mixer to disperse the paraffin in the gelatin aqueous solution.

After adding 0.18 g of formaldehyde (37% aqueous solution) as a hardener to the subbing solution, the solution was coated, while maintaining a temperature of 40° C., on a 0.2 m/m-thick polyethylene terephthalate support, polystyrene support or polymethyl methacrylate support having been subjected to glow discharge-processing under the same conditions as in Example 2 in a dry thickness of 2μ and, after setting for 1 minute at 5° C., dried for 30 minutes at 25° C. The resulting film had a smooth surface, although it was a little turbid as compared with that in Example 2.

On the thus-subbed film was coated the same photographic emulsion as in Example 1 in a dry thickness of 4μ and, after setting for 1 minute at 5° C., dried for 30 minutes at 30° C. The results thus-obtained are shown in Table 2.

TABLE 2

| Support | Adhesivity: Dry State | Adhesivity: In Developing Solution |
|---|---|---|
| Polyethylene Terephthalate | A | A |
| Polystyrene | A | A |
| Polymethyl Methacrylate | B | B |

EXAMPLE 4

15 g of a 5% by weight aqueous solution of sodium dodecylbenzenesulfonate (emulsifying agent) was added to 200 g of a 10% by weight gelatin aqueous solution maintained at 50° C. Then, a liquid prepared by dissolving an ester of an acid having 28 carbon atoms with an alcohol having 28 carbon atoms (solid to be dispersed) in 40 cc of benzene was added thereto, and the mixture was stirred for 25 minutes using a high speed agitator (20,000 r.p.m.). 0.18 g of a 37% formaldehyde aqueous solution (hardener) was finally added thereto to prepare a subbing solution.

The resulting subbing solution was coated in a dry thickness of 1μ on a 0.2 m/m-thick, flame-processed polyethylene terephthalate support and, after setting for 1 minute at 5° C., dried at 30° C. for 30 minutes. The thus-obtained film was substantially transparent.

On the thus-subbed support was coated a black-and-white silver halide photographic emulsion having the following formulation. The amounts given below are per 1 m$^2$ of the film.

| | |
|---|---|
| Silver Bromochloride (bromide: 3.5 mol %) | 3.5 g |
| Gelatin Hydroxyethyl Methacrylate Graft Polymer (graft ratio: 30 wt %) | 13.0 g |
| Polyethyleneoxide (12 ethyleneoxy units) | 0.03 g |
| Formaldehyde (37% aq. soln.) | 0.1 g |
| Water | 130 cc |

The adhesivity of the thus-obtained film was grade A both in a dry state and in each processing solution used in development, fixation, and washing. In addition, the photographic property was sufficiently satisfactory.

With a comparative sample prepared in the same manner except that the above-described solid dispersion was not added to the subbing solution, the adhesivity was grade E both in a dry state and in a wet state.

EXAMPLE 5

A subbing solution was prepared in the same manner as in Example 1 except for using β-methylnaphthalene (m.p.: 35.1° C.), as a solid to be dispersed, in place of the compound used in Example 1, and was coated in a dry thickness of 2μ on a polyethylene terephthalate film support having been subjected to corona discharge-processing in the same manner as in Example 1.

On the thus-subbed support was coated the same emulsion as in Example 1. The adhesivity of the resulting sample was grade A both in a dry state and in a wet state.

EXAMPLE 6

15 g of an aqueous solution of sodium dodecylbenzenesulfonate (emulsifying agent) and 10 g of solid paraffin dissolved in 40 cc of ethyl acetate and maintained at 60° C. were added to 200 g of a 10% by weight aqueous solution of maleic anhydride/methyl vinyl ether copolymer (copolymerization molar ratio: 1:1) (GANTREZ AN-139, trade name produced by General Aniline and Film Co.) maintained at 60° C., and the mixture was stirred for 20 minutes using a mixer to prepare a subbing solution. The resulting subbing solution was coated on a 0.1 μ-thick polyethylene terephthalate support having been subjected to corona discharge-processing under the same condition as in Example 1, and dried for 10 minutes at 120° C. The resulting film was almost transparent and just slightly turbid.

On the thus-subbed film was coated the same photographic emulsion as in Example 1 in a dry thickness of 6μ and, after setting for 1 minute at 5° C., dried for 30 minutes at 30° C.

The adhesiveness of the thus-obtained film was grade A in a dry state.

On the other hand, the adhesiveness of a comparative sample prepared by coating a 10 wt % methyl vinyl ether/maleic anhydride copolymer (as described above) solution on the above described corona discharge-processed support and coating the same emulsion as above was grade E in a dry state.

EXAMPLE 7

15 g of a 5% by weight aqueous solution of sodium dodecylbenzenesulfonate (emulsifying agent) was added to 200 g of a 5% by weight aqueous solution of polyvinyl alcohol (Gosenol NH-20, trade name, produced by Unitika, Ltd.). Then, a liquid prepared by dissolving 10 g of the compound shown in Example 1 as a solid to be dispersed in 40 cc of ethyl acetate was added thereto, and the mixture was stirred for 20 minutes using a mixer to prepare a subbing solution.

The resulting subbing solution was coated in a dry thickness of 1μ on a 0.2-thick polyethylene terephthalate support having been subjected to glow discharge-processing under the same condition as in Example 2, and dried for 10 minutes at 120° C. On the thus-subbed film was coated the same gelation-silver halide photographic emulsion as in Example 4. The adhesiveness of the film was grade B in a dry state.

On the other hand, the adhesiveness of a comparative sample prepared by coating a 10% by weight polyvinyl alcohol (as described above) solution on the support in a dry thickness of 1μ, drying for 10 minutes at 120° C., and coating the above-described photographic emulsion thereon was a grade E in a dry state.

EXAMPLE 8

20 g of a 5% by weight sodium dodecylbenzenesulfonate aqueous solution was added to 200 g of a 10% by weight gelatin aqueous solution. Then, a liquid prepared by dissolving 30 g of solid paraffin (m.p.: 58° C.) as a solid to be dispersed in 60 cc of ethyl acetate was added thereto and the mixture was stirred for 20 minutes using a mixer to obtain a dispersion.

200 g of the resulting dispersion was uniformly mixed with a black-and-white gelatino-silver halide photographic emulsion having the following formulation at 60° C.

| | |
|---|---|
| Gelatin | 20 g |
| Silver Chlorobromide (bromide: 3.5 mol%) | 10 g |
| Formaldehyde (37% aq. soln.) | 0.25 g |
| Polyethyleneoxide (as described in Example 4) | 0.05 g |
| Water | 200 g |

The thus-obtained photographic emulsion was coated in a dry thickness of 5μ on a 0.2 mm-thick polyethylene terephthalate film for X-ray use containing an anthraquinone blue dye and, after setting for 1 minute at 5° C., dried for 30 minutes at 30° C.

The adhesiveness of the thus-obtained photographic film was grade A both in a dry state and in a wet state.

Thus, it can be seen that the dispersion of a solid in a photographic emulsion layer according to the process of the present invention enables the photographic emulsion to be directly adhered intimately onto a non-subbed polyethylene terephthalate support.

EXAMPLE 9

10 g of poly(potassium p-styrenesulfonate) was added as a thickening agent to a subbing solution prepared in the same manner as in Example 3 to prepare a subbing solution.

The resulting subbing solution and the same photographic emulsion as in Example 4 were simultaneously coated, as a first layer and a second layer, respectively, on a 0.1 mm-thick polyethylene terephthalate support having been subjected to corona discharge-processing as in Example 1 using a slide coating method and, after setting for 2 minutes at 5° C., dried for 40 minutes at 30° C. The dry thickness of the subbing layer was 2μ, and that of the photographic layer 6μ. The adhesion testing with the resulting film showed that the adhesiveness of the film was grade A both in a dry state and in a wet state.

It can be seen that the process of the invention has enabled the simultaneous coating of the photographic emulsion layer and the subbing layer to be conducted.

While the invention has been described in detail and with reference to specific embodiments thereof, it will be apparent to one skilled in the art that various changes and modifications can be made therein without departing from the spirit and scope thereof.

What is claimed is:

1. A process for producing a photographic material having good adhesion between a support and a hydrophilic colloid photographic layer which comprises the steps of:

(1) liquifying a material which is solid at ordinary temperatures by heating in the absence of a liquid solvent;

(2) dispersing said liquified material in a solution of an organic resin which is incompatible therewith to form a dispersion wherein the size of the droplets of said liquified particles is not greater than 1μ;

(3) coating the resulting dispersion on at least one side of a support to form a coated layer;

(4) drying the coated layer to form a transparent layer containing solid particles of said material dispersed therein in a macroscopically uniform state in an order larger than the size of a single molecule and forming a different phase from that of the organic resin; and then, (5) coating a hydrophilic colloid photographic layer on said coated layer.

2. The process as described in claim 1, wherein said organic resin has good adhesivity to a hydrophilic photographic layer.

3. The process as described in claim 1, wherein the organic resin is a hydrophilic resin.

4. The process as described in claim 1, wherein the organic resin comprises at least gelatin or a gelatin derivative.

5. The process as described in claim 2, wherein said organic resin includes at least one resin which is the same as the organic resin of the photographic layer to be coated thereon.

6. The process as described in claim 2, wherein said photographic emulsion layer is coated simultaneously with the coating of said coating layer on said support.

7. The process as described in claim 1, wherein the material is present in a volume ratio of about 0.1:1 to 2:1 to said organic resin.

8. The process as described in claim 1, wherein said material is an organic compound having a melting point or a softening point of about 15° C. or higher.

9. The process as described in claim 1, wherein said material is a crystalline solid.

10. The process as described in claim 1, wherein said material is a non-diffusible material in the organic resin used and in an order larger than the size of a single molecule.

11. A photographic material comprising a support having thereon a coated layer produced by the process as described in claim 1 and a hydrophilic colloidal photographic layer thereon.

12. A process as described in claim 1, wherein the photographic layer is a gelatin silver halide light-sensitive layer.

13. The process as described in claim 1, wherein the photographic layer is an image receiving layer for diffusion transfer photography.

14. The process as described in claim 1, wherein the size of said liquid droplets is between 0.1 and 1 micron.

15. A process for producing a photographic material having good adhesion between a support and a hydrophilic colloid photographic layer which comprises the steps of:

(1) liquifying a material which is solid at ordinary temperatures by heating in the absence of a liquid solvent;

(2) dispersing said liquified material in a solution of an organic resin which is incompatible therewith to form a dispersion wherein the size of the droplets of said liquified particles is not greater than 1$\mu$;

(3) coating the resulting dispersion on at least one side of a support to form a coated layer; and (4) drying the coated layer to form a transparent layer containing solid particles of said material dispersed therein in a macroscopically uniform state in an order larger than the size of a single molecule and forming a different phase from that of the organic resin and wherein said coated layer is a hydrophilic colloidal photographic layer.

16. The process as described in claim 15, wherein the organic resin comprises at least a gelatin derivative.

17. The process as described in claim 15, wherein the material is present in a volume ratio of about 0.1:1 to 2:1 to said organic resin.

18. The process as described in claim 15, wherein said material is an organic compound having a melting point or a softening point of about 15° C. or higher.

19. The process as described in claim 15, wherein said material is a crystalline solid.

20. The process as described in claim 15, wherein said material is a non-diffusible material in the organic resin used and in an order larger than the size of a single molecule.

21. A photographic material comprising a support having thereon a coated layer produced by the process as described in claim 15.

22. The process as described in claim 15, wherein the size of said liquid droplets is between 0.1 and 1 micron.

* * * * *